United States Patent [19]

Winer

[11] 4,072,546

[45] Feb. 7, 1978

[54] USE OF GRAPHITE FIBERS TO AUGMENT PROPELLANT BURNING RATE

[75] Inventor: Richard Winer, Wilmington, Del.

[73] Assignee: Hercules Incorporated, Wilmington, Del.

[21] Appl. No.: 628,863

[22] Filed: Nov. 5, 1975

Related U.S. Application Data

[63] Continuation of Ser. No. 210,654, Dec. 22, 1971, abandoned.

[51] Int. Cl.[2] ..... C06B 45/10

[52] U.S. Cl. ..... 149/19.8; 149/2; 149/19.9; 149/20; 149/21; 149/96; 149/100; 102/102; 264/3 B

[58] Field of Search ..... 149/2, 19.8, 19.9, 20, 149/21, 96, 100, 108.2; 102/102; 264/3 B, 3 C

[56] References Cited

U.S. PATENT DOCUMENTS

| | | | |
|---|---|---|---|
| 3,141,294 | 7/1964 | Lawrence et al. | 149/44 X |
| 3,364,086 | 1/1968 | Oversohl et al. | 149/19.8 X |
| 3,389,025 | 6/1968 | Nix et al. | 149/19.9 X |
| 3,392,068 | 7/1968 | Knowles et al. | 149/87 X |
| 3,513,776 | 5/1970 | Driscoll | 102/38 |
| 3,567,805 | 3/1971 | Pierce | 149/2 X |
| 3,676,533 | 7/1972 | Dehm et al. | 264/3 C |
| 3,764,420 | 10/1973 | Sayles | 149/21 |

*Primary Examiner*—Edward A. Miller

[57] ABSTRACT

Solid propellant compositions having graphite fibers dispersed throughout the propellant are provided. The graphite fibers augment the burning rate of the solid propellant.

12 Claims, 4 Drawing Figures

RICHARD WINER
*INVENTOR*

BY Michael B. Keehan

*ATTORNEY*

USE OF GRAPHITE FIBERS TO AUGMENT PROPELLANT BURNING RATE

This is a continuation of application Ser. No. 210,654, filed Dec. 22, 1971, and now abandoned.

This invention relates to propellant compositions having graphite fibers incorporated therein for the purpose of increasing the burning rate of the propellant.

The burning rates of propellants have previously been augmented by incorporating metallic wires, ribbons or chopped foil into the propellant. The usual metals employed are aluminum, silver, and zirconium through many metals have been shown to be effective to various degrees. The metal may be introduced as particles in the form of continuous wires or ribbons, short wires or ribbons, chopped foil, platelets, flake, and the like. The metal particles may be purposely oriented or aligned in a given direction or they may be randomly dispersed. The metal particles may act by providing paths of high thermal diffusivity to transmit heat from the propellant combustion reaction surface to the propellant below the reaction surface, by reaction of the metal itself or by a combination of the two mechanisms. Depressions are generally formed in the propellant surrounding the metal particle during burning, increasing the propellant burning surface area. The increased surface area results in an increase in the rate of consumption of the propellant and in increased rate of gas generation as a result thereof.

Inclusion of metals in propellant can cause several disadvantages, depending on the type of propellant and the metal used, and also depending on the intended use of the propellant. The propellant containing metal particles may be more susceptible to accidental initiation from impact or frictional forces or from electrostatic discharge potential. The propellant mechanical properties may be degraded due to the introduction of inhomogenities in the propellant matrix. The propellant specific impulse may be reduced due to the low heat of reaction of certain metals. In some gas generators and in gun propellants, solid particles in the exhaust may be detrimental to hardware because of abrasive action. Smokeless propellants may have objectionable visible exhausts due to the products of combustion of the metal. Each of these disadvantages can be substantially reduced or overcome in accordance with the teaching of this invention.

It has now been found that tiny graphite fibers can be employed in all types of propellants such as gun propellants, gas generator propellants, small rocket propellants and in propellants for large missiles, to agument the burning rates thereof regardless of the method of manufacture and regardless of the orientation of the fibers in the propellant.

Graphite fibers are employed as chopped fibers having diameters of from about 4 to about 10 microns. The length of the graphite fibers employed can be varied over a wide range depending on the particular application. Lengths of fiber as short as several mils are effective for increasing burning rates of propellants. Lengths of fibers of from about $\frac{1}{4}$ inch to about $\frac{3}{4}$ inch are preferably employed. Fibers can be broken during mixing, so mixing is controlled to prevent destruction of the fibers. It has been found that burning rate augmentation decreases as the lengths of graphite fiber employed decreases.

The graphite fibers are employed in amounts of from about 0.03% to about 10% by weight, based on the total weight of the propellant composition. It is generally preferred to employ the fibers in an amount of from about 0.5% to about 6% by weight based on the weight of the propellant composition.

The graphite fibers should be completely distributed throughout the propellant for optimum controlled performance. Such distribution is achieved by thorough mixing in conventional mixing equipment employed in the propellant art. Substantially complete distribution can be achieved in most propellant formulations after about 10 minutes of mixing in conventional mixers. Suitable distribution of the graphite fibers can usually be evaluated by visual observation of the propellant. Microscopic examination of the propellant can be made if desired.

Graphite fibers consist essentially of carbon atoms arranged in the crystal form characteristic of graphite. Graphite fibers can be prepared from natural or synthetic organic materials. Illustrative precursor material from which carbon fibers are made include, but are not limited to, polyacrylonitrile, cellulose, regenerated cellulose, polyvinylalcohol, polyvinylchloride, polyesters, polyamides, pitch and the like.

Propellants containing the graphite fibers can be made by any suitable method such as by conventional casting, slurry casting, and extrusion. All of such processing methods are well known in the propellant art. The propellant matrix into which the fibers are incorporated can be of the single base, double base, triple base, or composite type which term is defined herein to include composite modified double base propellants.

The use of graphite fibers in preparation of smokeless gun propellants is of particular interest since gun propellant formulations can be prepared employing composite type propellant in which the characteristics of certain composite propellants such as low flame temperatures and low molecular weight combustion gases can be taken advantage of, while the burning rate of the composite propellant is substantially increased by incorporation of graphite fibers.

Figure 1:
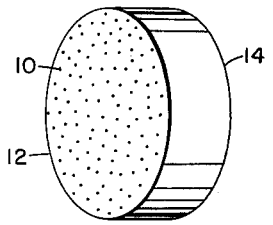
FIGS. 1, 2, and 3 show various powder granules
Figure 2:
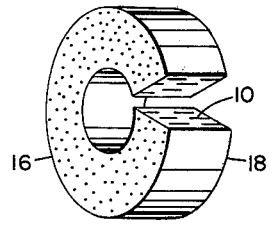
Figure 3:
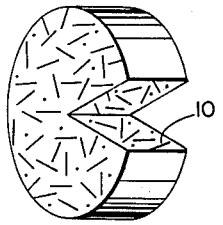

In preparing the propellant compositions of this invention, the graphite fibers may be either randomly dispersed or aligned depending upon the method employed to manufacture the propellant. If the propellant is extruded into the shape of a granule having a longitudinal axis such as in the preparation of base grain for a cast propellant, or in preparation of gun propellant by conventional extrusion processes, a substantial proportion of the graphite fibers will be oriented perpendicular to the end burning surface of the propellant granule, i.e., parallel to the longitudinal axis of the granule. Orientation of graphite fibers in propellant granules is illustrated in FIGS. 1 and 2. The fibers 10 are oriented perpendicular to end burning surfaces 12, 14, 16, 18. Random orientation of graphite fibers is shown schematically in FIG. 3. Maximum increase in propellant burning rate has been found to occur when the graphite fibers are oriented perpendicular to the burning surface.

The propellant compositions of this invention are more fully illustrated in the Examples which follow. In the Examples, parts and percentages are by weight unless otherwise specified.

EXAMPLE 1

About 13 parts of carboxy terminated polybutadiene rubber, 0.5 parts of a curing agent for said rubber and 4.3 parts of methylisobutylketone, which is a solvent for the rubber, are added to a mixer which is preheated to 120° F. These ingredients are mixed for five minutes. Then, 24 parts of organic oxidizing agent and 0.4 parts of graphite fibers having a nominal diameter of about 9μ and having an average length of about 0.2 inch are added to the mixture and mixing is continued for ten minutes. The graphite fibers employed are available commercially from Hercules Incorporated and are sold as Type HM-S. About 24 parts of the organic oxidizing agent, 0.4 parts of graphite fibers, and 4.3 parts of methylisobutylketone are added to the mixture and mixing is continued for an additional ten minutes. Twenty-four parts of the organic oxidizing agent, 0.4 parts of graphite fibers, and 4.3 parts of methylisobutylketone are again added to the mixture and mixing is continued for an additional ten minutes. The final portion of 0.4 parts of graphite fibers is added to the mixer and the total mixture is mixed for 2 hours at 120° F. with the mixer lid closed. The mixer lid is then opened and the methylisobutylketone solvent is allowed to evaporate until a propellant dough of extrusion consistency results. The dough is extruded from a $2\frac{7}{8}$ inch diameter extrusion press through a 0.250 inch diameter die at 900–1100 psig. The extruded propellant strands are cut into six inch lengths and cured for four days at 140° F.

EXAMPLES 2 AND 3

Example 1 is repeated, except the total graphite fiber content of the propellant is increased from the 2.0% by weight level, to 4.0% by weight (Example 2) and 6.0% by weight (Example 3). The fibers are added in four equal increments as in Example 1.

EXAMPLE 4

A control propellant composition is prepared in which no graphite fibers are added. The propellant composition and mixing procedure is the same as employed in Example 1 with the exception of the deletion of the graphite fibers.

The effect of graphite fiber strands on the burning rate of the composite gun propellant composition of Examples 1–4 is evaluated by burning the strands conditioned to 77° F. in an Atlantic Research Corporation Strand Bomb Apparatus. Results of the strand burning tests at various test pressures are set forth in Table I which follows.

TABLE I

| Example | 1 | 2 | 3 | 4 |
|---|---|---|---|---|
| Weight % Graphite Fibers | 2.0 | 4.0 | 6.0 | 0.0 |
| Bomb Pressures (lbs./in$^2$ - gauge) | Propellant Burning Rates (Inches/second) | | | |
| 1000 | 0.255 | 0.360 | 0.417 | 0.154 |
| | 0.258 | 0.347 | 0.417 | 0.154 |
| | | 0.347 | 0.419 | |
| 1500 | 0.341 | 0.522 | 0.546 | 0.192 |
| | 0.323 | 0.522 | 0.551 | 0.192 |
| | | 0.453 | 0.563 | 0.195 |
| 2000 | 0.381 | 0.537 | 0.672 | 0.243 |
| | 0.391 | 0.537 | 0.741 | 0.238 |
| | | 0.543 | 0.757 | |
| 2500 | 0.420 | 0.616 | 0.723 | 0.301 |
| | 0.427 | 0.615 | 0.743 | 0.299 |
| | | 0.608 | 0.754 | 0.284 |
| 3000 | 0.480 | 0.688 | 0.812 | 0.329 |
| | 0.469 | 0.688 | 0.825 | 0.325 |

TABLE I-continued

| Example | 1 | 2 | 3 | 4 |
|---|---|---|---|---|
| Weight % Graphite Fibers | 2.0 | 4.0 | 6.0 | 0.0 |
| Bomb Pressures (lbs./in$^2$ - gauge) | Propellant Burning Rates (Inches/second) | | | |
| | | 0.698 | 0.857 | 0.358 |

Figure 4:
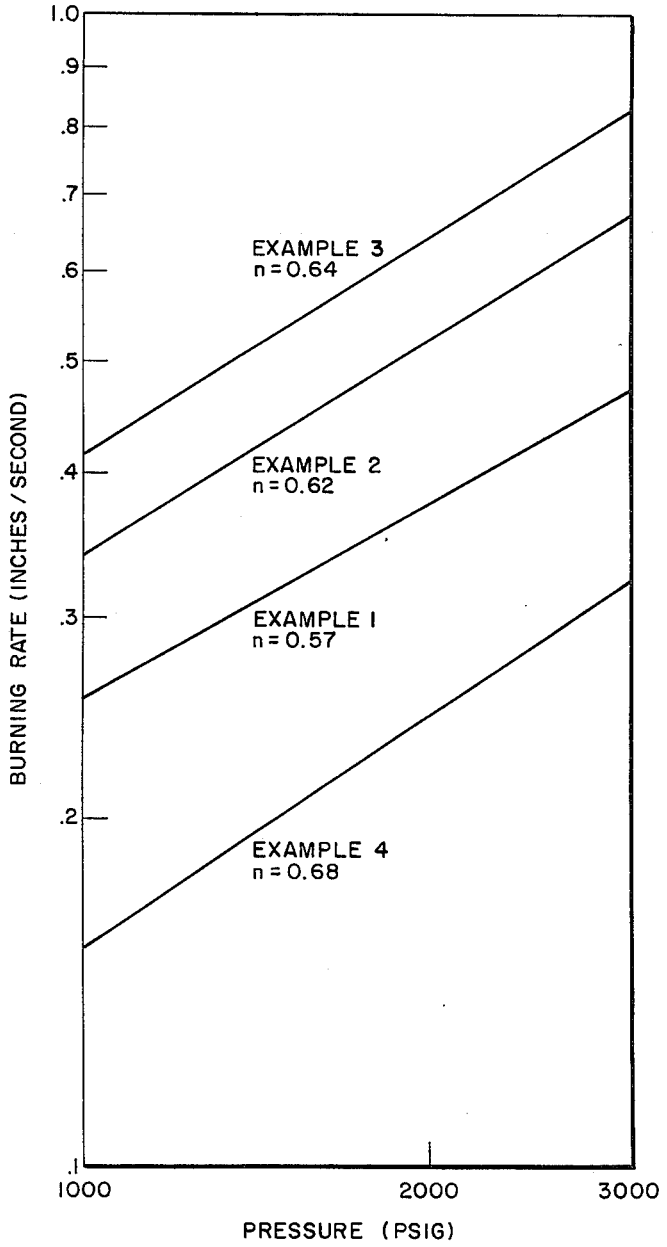
FIG. 4 is a graph showing burning rate vs. pressure.

The effect of the graphite fibers on the burning rate of the gun propellant compositions is clearly illustrated by comparison of the burning rate data presented in Table I. Thus, at 3000 psig for example, the burning rates of the composite propellant prepared in Example 1 (2% graphite fiber), Example 2 (4% graphite fiber), and Example 3 (6% graphite fiber) are increased 46%, 108%, and 155% respectively, over the burning rate of the control propellant, Example 4. The effect of graphite fibers on the gun propellant burning rate is graphically presented in FIG. 4 in the plot of burning rate (inches/second) versus pressure (lbs./in.$^2$ - gauge). The slope of the curves, *n*, is seen to be less than the slope of control propellant, Example 4.

EXAMPLES 5–10

The following examples illustrate the increased burning rates achieved by incorporating graphite fibers into composite modified-double base propellants. In these examples the graphite fibers are added to the propellant matrix during mixing and extruded into propellant strands. In Example 6, the small amount of fibers is added in a single increment. In Example 7 and Examples 8, 9, 10, the fibers are added in two and three equal increments, respectively. Each of the extruded strands is dried and heat cured for 3 days at 140° F. The strands are burned in an Atlantic Research Corporation Strand Bomb Apparatus at 2000 psi, after conditioning of the strands to 77° F. The basic propellant composition and the effects of the graphite fiber on propellant burning rate are set forth in Table II. Example 5 is a control propellant.

TABLE II

| Ingredient | Example | | | | | |
|---|---|---|---|---|---|---|
| Weight (%) | 5 | 6 | 7 | 8 | 9 | 10 |
| Nitrocellulose | 16.2 | 16.3 | 16.2 | 15.1 | 15.1 | 15.1 |
| Nitroglycerin | 32.3 | 32.3 | 32.3 | 30.1 | 30.0 | 30.0 |
| Triacetin | 5.7 | 5.7 | 5.7 | 5.3 | 5.3 | 5.3 |
| Surfactant | 0.2 | 0.2 | 0.2 | — | 0.2 | 0.2 |
| Stabilizers | 2.3 | 2.1 | 2.3 | 2.1 | 2.1 | 2.1 |
| Ammonium perchlorate | 43.3 | 43.3 | 43.0 | 40.2 | 40.1 | 40.1 |
| Aluminum powder | 0 | 0 | 0 | 4.2 | 4.2 | 4.2 |
| Graphite fiber[1] (Type HM-S) | 0 | 0.03 | 0.3 | 3.0 | 0 | 0 |
| Graphite fiber[2] (Type HM-U) | 0 | 0 | 0 | 0 | 3.0 | 0 |
| Graphite fiber[3] (Type HT-S) | 0 | 0 | 0 | 0 | 0 | 3.0 |
| '2000 (in/sec) | 3.0 | 6.1 | 6.6 | 8.6 | 9.0 | 6.3 |

[1]Prepared from polyacrylonitrile (PAN) precursor; modulus 50–60 × $10^6$ psi; surface treated
[2]Prepared from (PAN) precursor; modulus 50 - 60 × $10^6$ psi; no surface treatment
[3]Prepared from (PAN) precursor; modulus 32 - 40 × $10^6$ psi; surface treated As can be readily seen from the burning rate data for Examples 5–10 in Table II, the burning rates of composite modified double base propellants containing graphite fiber (Examples 6–10) were all greatly increased over the control propellant burning rate (Example 5). In these examples, a substantial proportion of the graphite fibers are oriented perpendicular to the end burning surfaces of the propellant strands during the extrusion of the strands.

EXAMPLES 11–12

The following Examples illustrate the use of graphite fibers in preparation of propellants by conventional slurry casting methods. The graphite fibers employed in the propellant composition of Example 12 is added to a slurry of the propellant ingredients. Example 11 is a control composition. The graphite fibers employed are chopped and have an average initial length of ¼ inch. After the propellant ingredients are mixed in the slurry, blocks of propellant are cast and cured for five days at 140° F. Strands ¼ inch × ¼ inch × 4 inches are sawed from the cured blocks. The strands are burned in an Atlantic Research Corporation Strand Bomb Apparatus at 1000 psi, and the burning rates are measured. The burning rate data of these compositions are set forth in Table III.

TABLE III

| Ingredient Weight (%) | Example 11 | Example 12 |
|---|---|---|
| Nitrocellulose (Plastisol type) | 11.1 | 11.0 |
| Nitroglycerin | 41.4 | 41.0 |
| Crosslinking agent | 7.4 | 7.3 |
| Plasticizer | 4.9 | 4.9 |
| Stabilizer | 1.0 | 1.0 |
| Ballistic modifiers | 4.0 | 4.0 |
| Cyclotrimethylenetrinitramine | 30.0 | 29.8 |
| Carbon black(colloidal) | 0.2 | 0 |
| Graphite fiber (Type HM-S) | 0 | 1.0 |
| '1000 (in./sec.) | 0.37 | 0.48 |

Burning rate data show an increased burning rate for the propellant of Example 12 of about 30% compared to the propellant composition of Example 11.

The solid propellant compositions of this invention having graphite fibers uniformly incorporated therein to augment burning rates can be of the single base, double base, triple base and composite type composition. Single base compositions are prepared principally from nitrocellulose and generally contain stabilizing agents. Double base propellants are principally prepared from nitrocellulose, and nitroglycerin or a similar type explosive plasticizer for nitrocellulose. Triple base propellants are prepared principally from nitrocellulose, nitroglycerin or similar explosive plasticizer for nitrocellulose and nitroguanidine. Composite type propellants are prepared principally from a polymeric binder and an oxidizing agent in solid particulate form dispersed throughout the binder. Illustrative polymeric binders employed in preparation of composite propellants include carboxyterminated polybutadiene, hydroxyterminated polybutadienes, polyethers, polyurethanes and the like. The binders are prepared from liquid polymers which are crosslinked with curing agents to produce the propellant binder. Oxidizing agents are incorporated in the uncured binder during mixing of the propellants. Illustrative oxidizing agents which can be employed include inorganic solid oxidizing agents such as ammonium perchlorate, and organic solid oxidizing agents such as cyclotrimethylene trinitramine (RDX), cyclotetramethylene tetranitramine (HMX), pentaerythritol tetranitramine, ethylene dinitramine, mixtures thereof, and the like.

What I claim and desire to protect by Letters Patent is:

1. A solid propellant composition for use as a solid propellant in rocket motors, said composition being selected from the group consisting of single base, double base, triple base composite and composite modified double base composition types, said solid propellant composition containing a multiplicity of graphite fibers having diameters of from about 4 microns to about 10 microns substantially uniformly distributed throughout said solid propellant composition said graphite fibers comprising from about 0.03% to about 10% by weight based on the weight of the solid propellant composition.

2. The solid propellant composition of claim 1 in which the graphite fibers comprise from about 0.5% to about 6% by weight based on the weight of the solid propellant composition.

3. The solid propellant composition of claim 1 in which the propellant composition is of the single base type.

4. The solid propellant composition of claim 1 in which the propellant composition is of the double base type.

5. The solid propellant composition of claim 1 in which the propellant composition is of the triple base type.

6. The solid propellant composition of claim 1 in which the propellant composition is of the composite type.

7. The solid propellant composition of claim 6 in which the composite propellant comprises an inorganic oxidizing agent and a binder prepared from carboxyterminated polybutadiene.

8. The solid propellant composition of claim 7 in which the oxidizing agent is ammonium perchlorate.

9. The solid propellant composition of claim 7 in which the oxidizing agent is an organic type oxidizing agent selected from the group consisting of cyclotrimethylene trinitramine, cyclotetramethylene tetranitramine, pentaerythritol tetranitrate, ethylene dinitramine, and mixtures thereof.

10. The solid propellant composition of claim 1 in which the composition is in the shape of a propellant granule having a longitudinal axis and a substantial proportion of the graphite fibers are oriented parallel to said longitudinal axis.

11. In a rocket motor utilizing a solid propellant composition selected from the group consisting of single base, double base, triple base, composite and composite modified double base composition types as the source of propulsion, the improvement comprising said solid propellant composition having incorporated therein a multiplicity of graphite fibers having diameters of from about 4 microns to about 10 microns, said fibers being substantially uniformly distributed throughout said solid propellant composition, said graphite fibers comprising from about 0.03% to about 10% by weight based on the weight of the propellant composition, whereby the burning rate of said solid propellant composition is increased.

12. The rocket motor of claim 11 in which said graphite fibers comprise from about 0.5% to about 6% by weight based on the weight of the propellant composition.

* * * * *